US006536619B2

(12) United States Patent
Gaydosh et al.

(10) Patent No.: US 6,536,619 B2
(45) Date of Patent: Mar. 25, 2003

(54) NON-ROCKING, WEBBED CONTAINER FOR CARBONATED BEVERAGES

(75) Inventors: Kevin D. Gaydosh, Adrian, MI (US); David A. Deemer, Adrian, MI (US)

(73) Assignee: Schmalbach-Lubeca AG (DE)

( * ) Notice: Subject to any disclaimer, the term of this patent is extended or adjusted under 35 U.S.C. 154(b) by 0 days.

(21) Appl. No.: 09/997,105

(22) Filed: Nov. 29, 2001

(65) Prior Publication Data

US 2002/0033376 A1 Mar. 21, 2002

Related U.S. Application Data

(63) Continuation of application No. 09/242,788, filed as application No. PCT/US97/15868 on Sep. 9, 1997.
(60) Provisional application No. 60/025,693, filed on Sep. 9, 1996.

(51) Int. Cl.[7] ..... B65D 90/12
(52) U.S. Cl. ..... 215/375; 220/606
(58) Field of Search ..... 215/374, 343, 215/375, 6; 220/606, 605, 604, 603

(56) References Cited

U.S. PATENT DOCUMENTS 4,249,667 A 2/1981 Pocock et al.
4,276,987 A 7/1981 Michel
4,520,936 A 6/1985 Lyons
4,865,206 A 9/1989 Behm et al.
4,978,015 A 12/1990 Walker
5,232,108 A 8/1993 Nakamura
5,287,978 A 2/1994 Young et al.
5,398,828 A 3/1995 Valyi
5,549,210 A 8/1996 Cheng
5,579,937 A 12/1996 Valyi
6,059,139 A 5/2000 Landreneau

*Primary Examiner*—Tri M. Mai
(74) *Attorney, Agent, or Firm*—Harness, Dickey & Pierce, P.L.C.

(57) ABSTRACT

A blow molded plastic container including a neck finish, a shoulder portion, a sidewall, and a base integrally formed with one another. Two indentations in the sidewall create a handgrip and a web extends generally across the interior of the container between the two indentations. A plurality of generally downwardly extending support feet include short feet and long feet. Separating the support feet are a plurality of first and second strap formations. Support surface contact points of the long feet are in a planar relationship with respect to one another, thereby providing the container with stability when empty. After filling, capping and pressurizing, the support surface contact points of the short feet and the support surface contact points of the long feet are all in a planar relationship with respect to one another, thereby providing the container with stability when filled.

19 Claims, 2 Drawing Sheets

NON-ROCKING, WEBBED CONTAINER FOR CARBONATED BEVERAGES

CROSS-REFERENCE TO RELATED APPLICATIONS

This application is a continuation of U.S. patent application Ser. No. 09/242,788 filed on Feb. 19, 1999, which is a national phase filing of PCT/US97/15868, filed Sep. 9, 1997, claiming priority to Provisional Application No. 60/025,693, filed Sep. 9, 1996.

BACKGROUND OF THE INVENTION

1. Field of the Invention

The present invention relates to plastic containers for beverages. More specifically, containers to which the present invention will have particular application include carbonated beverage containers having a support web extending across the interior of the container and having a footed base structure. Such containers are often formed from polyethylene terephthalate (PET), polyolefin, polyethylene napthalate (PEN) or other suitable materials.

2. Description of the Prior Art

Generally, carbonated beverage containers are formed from an injection or extrusion molded preform which is blow molded within a blow mold into the desired configuration. The container includes a neck finish (which also defines the opening into the container and which includes threads for retaining a closure cap on a container), a shoulder portion extending downward from the neck finish, a base which closes off the bottom of the container and a sidewall or body extending between the shoulder portion and the base. The base can be provided in a variety of styles. One style is a champagne base configuration. This style has an inwardly directed, conical portion which also defines a support ring around the base. Another style is a footed base configuration with two or more feet.

While carbonated beverage containers come in a wide variety of sizes, one of the more popular sizes is the common two liter bottle. This container is preferred by the public because of the convenience and the economy which it provides to the end consumer. Because these containers have a relatively large diameter, they have proven awkward during handling and pouring, especially for individuals with small hands. This problem is further compounded when the container has yet to be opened. In that situation the internal pressure of the container causes an outward bulging in the container sidewall further increasing the container's diameter.

In an attempt to alleviate the above problem, it has been proposed to form a carbonated beverage container having recesses or depressions in its sidewall to form a handgrip. U.S. Pat. No. 5,398,828 discloses one such container and is incorporated herein by reference. The container of that patent is formed with two generally opposed depressions in its sidewall and the depressions operate as a handgrip for the container. To prevent the everting of the handgrips, an internal supporting structure was incorporated into the container. This support is in the form of a web or wall extending across the diameter of the container between the handgrips.

While the web works in allowing the container to be formed with handgrips, it has been found that the base of such a container, particularly when filled, capped and pressurized, causes the container to "rock" or "wobble" when the container is placed on a flat support surface. While not completely and fully understood, it is believed that the incorporation of the web into the container has an effect on providing support to the feet located adjacent to the web. As a result, when the container is pressurized, the outboard feet (those feet not adjacent to the web) expand in a manner different from those feet adjacent to the web causing the rocking problem. This rocking problem is particularly noted when the container is provided with a footed base, as is currently standard practice in the industry.

In view of the foregoing limitations and shortcomings of the prior art devices, as well as other disadvantages not specifically mentioned above, it should be apparent that there still exists a need in the art for an improved carbonated beverage container of the above variety.

It is therefore a primary object of this invention to fulfill that need by providing a footed, carbonated beverage container which resists rocking of the container before and after pressurization.

Another object of the present invention is to provide a carbonated beverage container having handgrips and which resists rocking of the container before and after pressurization of the container.

Additional benefits and advantages of the present invention will become apparent to those skilled in the art to which the present invention relates from the subsequent description of the preferred embodiment and the appended claims, taken in conjunction with the accompanying drawings.

DESCRIPTION OF THE INVENTION

Figure 1:
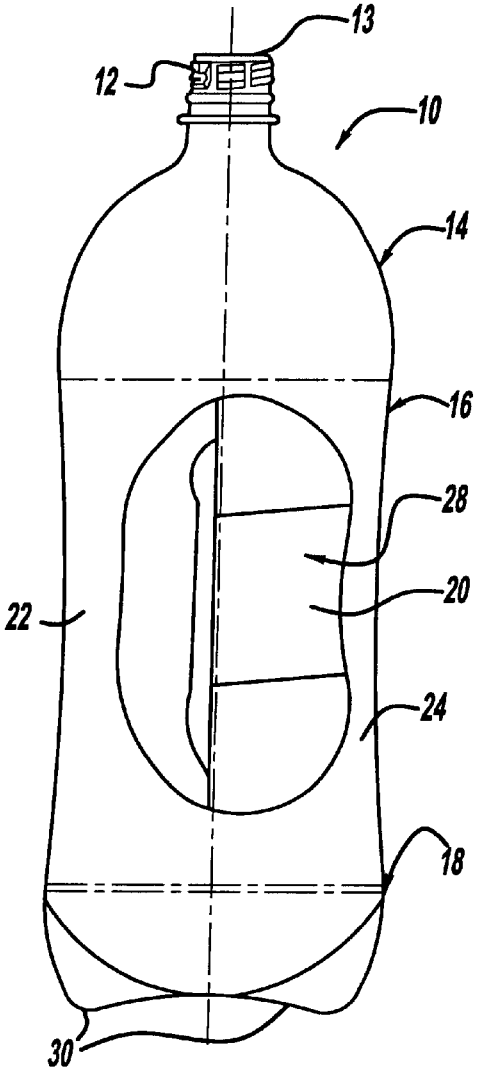
FIG. 1 is a side elevational view of a container embodying the principles of the present invention and illustrating only two of the feet in the base of the container.
Figure 2:
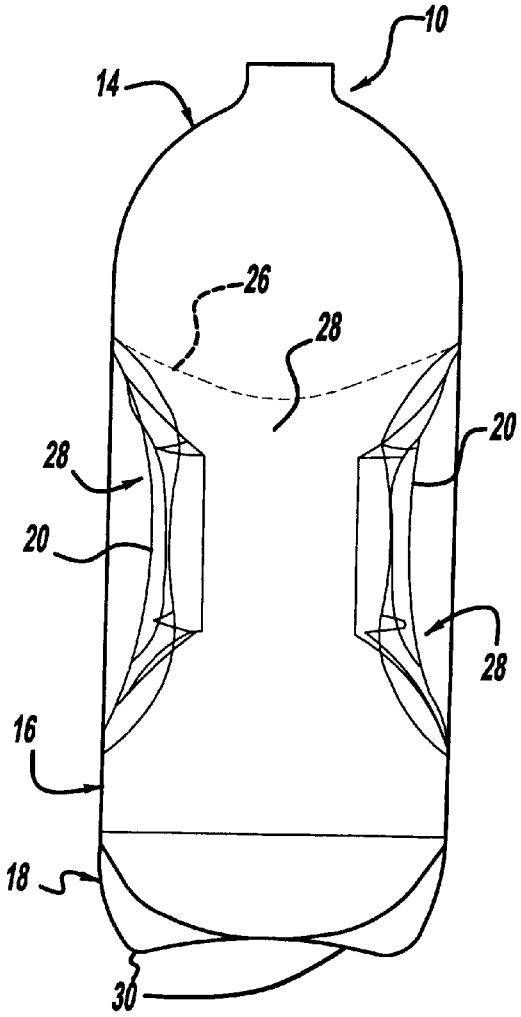
FIG. 2 is a side elevational view of the container seen in FIG. 1 with the container rotated 90° to the left and illustrating two of the feet in the base of the container.

Briefly described, the above and other objects are accomplished according to the present invention by providing a carbonated beverage container 10 which is formed into the configuration generally seen in FIGS. 1 and 2. Located at the top of the container 10 is a neck finish 12 which defines an opening 13 into the interior of the container 10. The finish 12 is threaded and permits the engagement of a closure cap (not shown) with the container 10. Integrally formed with the neck finish 12 and extending downward therefrom is a shoulder portion 14 which merges into the sidewall or body 16 of the container 10. At the lower end of the sidewall 16 is an integrally formed base 18 that closes off the bottom of the container 10.

The sidewall 16 of the container 10 is formed with a pair of generally opposed indentations or recesses 20. The recesses 20 are designed to form handgrip areas 28 in the sidewall 16 of the container 10 and they also divide the sidewall 16 of the container 10 into a front lobe 22 and a rear lobe 24. In order to structurally support the handgrips 28, a web 26 extends generally across the interior of the container 10, between the recesses 20. The web 26 also extends from the base 18 of the container 10 up to approximately the upper portion of the recesses 20. The web 26 is perhaps best seen in FIGS. 2, 3 and 4.

As a result of the incorporation of the web 26 into the container 10, the base 18 of the container 10 operates, both during and after molding, in a manner which differs from non-webbed containers. As a result, it has been found that when a webbed container is filled with a product, capped and pressurized, the resulting base of the container is uneven and the container rocks on the base.

To alleviate the rocking problem, the present invention incorporates two different strategies. First, feet 30 on the base 18 are not molded having the same height. Second, the profile of straps 32, those portions which extend between adjacent feet 30, is not the same for all the straps 32 in the container 10. Each of these strategies are further discussed below.

Figure 3:
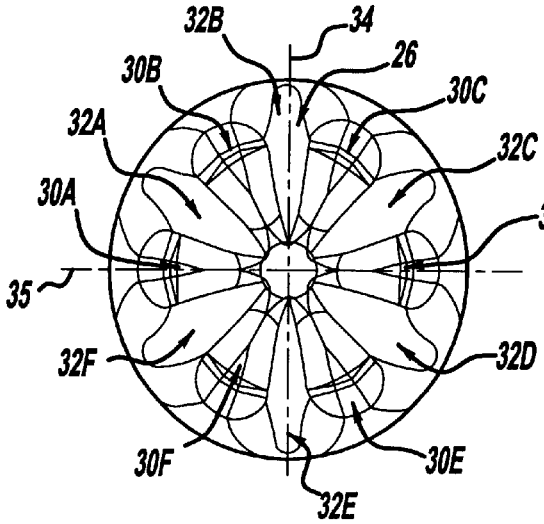
FIG. 3 is a bottom view of the footed base of the container seen in FIG. 1.

As seen in FIG. 3, the preferred embodiment of the present container 10 incorporates a six footed base design with an equal amount of feet 30 being located on opposing sides of a plane 34 defined axially through the container 10 by the web 26. The feet 30 are individually designated as foot 30A through foot 30F, with foot 30A and foot 30D located approximately 180° from each other on opposing sides of a plane 35 defined axially through the container 10, each of foot 30A and foot 30D are thereby located at approximately 90° right angles relative to the web 26. Also for reference, as seen in FIG. 3, it is noted that foot 30A, foot 30B, and foot 30F are located on one side of the web 26, while foot 30C, foot 30D, and foot 30E are located on the opposing side of the web 26. Located between each adjacent foot 30 are straps 32 mentioned above. Straps 32 are designated as straps 32A through 32F with straps 32B and 32E corresponding with the web 26.

In order to solve the rocking problem discussed above, the blow mold in which the container 10 is formed is tooled so that the container cavity defines feet of differing lengths. In the specifically illustrated embodiment, foot 30A and foot 30D, the feet located on opposing sides of the plane 35 and at approximately 90° right angles relative to the web 26, are formed to be shorter than the remaining feet, foot 30B, foot 30C, foot 30E, and foot 30F. Accordingly, foot 30A and foot 30D can be referred to as the short feet while foot 30B, foot 30C, foot 30E, and foot 30F can be referred to as the long feet.

As illustrated in the figures, the particular container illustrated therein is a two liter container weighing approximately 58 grams. The height X (see FIG. 4) of the short feet 30A and 30D measured between a horizontal datum 36 drawn through the container 10 and a short feet contact point 37 with a support surface 39 is 38.44 mm. The height Y (see FIG. 5) of the long feet 30B, 30C, 30E, and 30F measured between the horizontal datum 36 and a long feet contact point 41 with the support surface 39 is 38.68 mm. Accordingly, it can be seen that the short feet 30A and 30D have a length which is approximately 0.24 mm less than the long feet 30B, 30C, 30E, and 30F. The support surface 39 contact point 41 of the long feet 30B, 30C, 30E, and 30F are all in a planar relationship with respect to one another thus providing the container 10 with stability when empty. Similarly, when the container 10 is empty, the support surface 39 contact point 37 of the short feet 30A and 30D are both in a planar relationship with respect to each other. It should be noted that while specific dimensions are being recited herein, these dimensions may necessarily vary and be greater or lesser than the above dimension depending on the specific design and size of the container. However, the general principles discussed herein will apply equally as well to those of other containers. Accordingly, a greater or lesser height difference and overall height for the feet 30 could be used in containers of the same size, in containers of differing sizes and in containers of differing designs.

Figure 4:
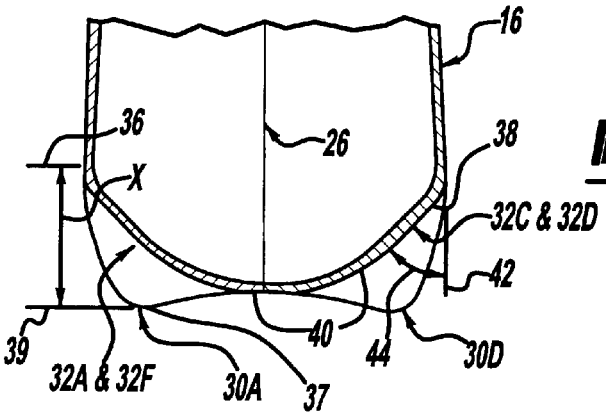
FIG. 4 is a diagrammatic sectional view of the lower portion of the container seen in FIG. 1.
Figure 5:
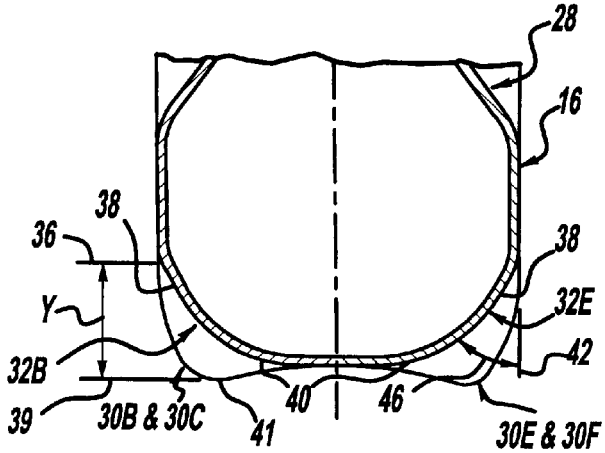
FIG. 5 is a diagrammatic sectional view of the lower portion of the container seen in FIG. 2.

In addition to the different foot heights, the container 10 is also constructed with straps 32 of varying configurations and profiles. More specifically, straps 32B and 32E, between the adjacent long feet 30B and 30C, and 30E and 30F differ in their configuration from the configuration of straps 32F, 32A, 32C, and 32D located between the long and short feet 30F and 30A, 30A and 30B, 30C and 30D, and 30D and 30E. Referring to the strap designations, straps 32B and 32E are configured with the same profile as generally seen in FIG. 5. Straps 32A, 32C, 32D, and 32F are configured with the same profile as seen in FIG. 4. It is noted that in both FIGS. 4 and 5, the cross section through the container 10 shows both the straps 32 and the feet 30. For a reduction in the number of drawings, these cross sections are accordingly illustrated as composites in these figures.

The configuration of all of the straps 32 is similar to the extent that an upper portion 38, that portion closest to the sidewall 16 of the container 10, is generally planar while a lower portion 40 is defined by a radius of curvature. In the illustrated embodiment, the upper portion 38 of straps 32A, 32F, 32C and 32D is provided with an angularity 44 that, when measured from a generally vertical line 42, is inclined at approximately 45° (see FIG. 4). The upper portion 38 of straps 32B and 32E is provided with an angularity 46 that, when measured from the generally vertical line 42, is inclined at approximately 31° (see FIG. 5). Accordingly, straps 32A, 32F, 32C, and 32D are closer to horizontal than straps 32B and 32E. Furthermore, the radius of curvature for straps 32A, 32F, 32C, and 32D is less than the radius of curvature for straps 32B and 32E. These are respectfully illustrated as being 58.9 mm and 84.14 mm. A difference of about 25.24 mm. From this it is seen that the straps 32B and 32E, which correspond with the web 26 are generally flatter in their lower portions 40 and generally steeper in their upper portions 38 than straps 32A, 32F, 32C and 32D (see FIGS. 4 and 5).

As with the prior discussion regarding the height of the feet 30, the specifically recited dimensions of the strap 32 profiles are those for the particular container 10 illustrated in the figures. Variations in container size and shape are anticipated to result in necessary changes in these dimensions. Such changes, however, are well within the purview of this invention.

After filling, capping and pressurizing, it has been found that the short feet 30A and 30D, and the long feet 30B, 30C, 30E and 30F effectively undergo different movement as a result of pressurization and non-symmetrical bulging in the sidewall 16 caused by the presence of the web 26. When provided with strap profiles of the same configuration, the result is feet having differing heights and a rocking container. By configuring the feet 30 and straps 32 as described above, the bulging of the sidewall 16 and movement of the feet 30 is controlled so as to produce a pressurized container 10 whose feet 30 all exhibit substantially the same height even though undergoing different movements, enabling the container 10 to resist rocking. Thus, after filling, capping and pressurizing, the support surface 39 contact point 37 of the short feet 30A and 30D, and the support surface 39 contact point 41 of the long feet 30B, 30C, 30E and 30F are all in a planar relationship with respect to one another, thereby providing the container 10 with stability when filled. Since rocking is resisted both before and after filling, the benefits of the present construction are seen not only during use by the end consumer, but also during the transporting, labeling, filling and manufacturing of the container.

While six feet are illustrated in the preferred embodiment, it should be understood that a lesser number or a greater number of feet could also be utilized. While it is believed that an even number of feet is preferred, in the appropriate context an odd number of feet might also be employed. At a minimum, however, a container 10 embodying the principles of the present invention would incorporate at least two feet, one located on each side of the web 26. In such a two footed design, the height of each foot would vary over its width.

While the above description constitutes the preferred embodiment of the present invention, it will be appreciated that the invention is susceptible to modification, variation and change without departing from the proper scope and fair meaning of the accompanying claims.

What is claimed is:

1. A blow molded plastic container comprising a neck finish, a shoulder portion, a sidewall, a base and a web integrally formed with one another, said web located within said container extending between opposing portions of said sidewall, a plurality of generally downwardly extending support feet intended to contact a support surface and support said container thereon, said support feet being formed at spaced apart locations circumferentially around said base, at least two of said support feet having a first height and the remainder of said support feet having a second height, said first and second heights being measured from a common horizontal datum through said container, said first height being less than said second height, wherein said support feet having said first height move, establishing a third height substantially equal to said second height such that all of said support feet contact said support surface when said container is pressurized.

2. The container of claim 1 wherein said plastic is a polyethylene terephthalate.

3. The container of claim 1 wherein said support feet having said second height contact said support surface.

4. The container of claim 1 wherein adjacent ones of said support feet are separated by strap formations, said strap formations defining profiles in vertical cross section, at least two of said strap formations defining a first profile and the remainder of said strap formations defining a second profile.

5. The container of claim 4 wherein said profiles include a generally planar upper portion and a generally semi-circular lower portion.

6. The container of claim 1 wherein said support feet having said first height are located on said base generally opposite one another.

7. The container of claim 1 wherein said support feet having said first height are located generally 90° from a plane defined by said web.

8. The container of claim 1 further comprising at least two indentations protruding inward from said sidewall forming handgrips such that said container can be easily grasped.

9. The container of claim 8 wherein said web extends upwardly from said base to approximately an upper portion of said indentations.

10. The container of claim 1 pressurized with a carbonated beverage.

11. A blow molded plastic container comprising a neck finish, a shoulder portion, a sidewall, a base and a web integrally formed with one another, said web located within said container extending between opposing portions of said sidewall, a plurality of generally downwardly extending support feet intended to contact a support surface and support said container thereon, said support feet being formed at spaced apart locations circumferentially around said base, at least two of said support feet having a first height and the remainder of said support feet having a second height, said first and second heights being measured from a common horizontal datum through said container, said first height being less than said second height, wherein two of said support feet having said first height are located generally 90° from a plane defined by said web.

12. A blow molded plastic container comprising a neck finish, a shoulder portion, a sidewall, a base and a web integrally formed with one another, said web located within said container extending between opposing portions of said sidewall, at least five generally downwardly extending support feet intended to contact a support surface and support said container thereon, said support feet being formed at spaced apart locations circumferentially around said base, at least two of said support feet having a first height and the remainder of said support feet having a second height, said first and second heights being measured from a common horizontal datum through said container, said first height being less than said second height, wherein said support feet having said first height move, establishing a third height substantially equal to said second height such that all of said support feet contact said support surface when said container is pressurized.

13. The container of claim 12 wherein said support feet having said second height contact said support surface when said container is empty.

14. The container of claim 12 wherein two of said support feet having said first height are located generally 90° from a plane defined by said web.

15. The container of claim 12 wherein said support feet having said first height are located on said base generally opposite one another and said support feet having said second height are located on said base generally adjacent to said web.

16. A blow molded plastic container comprising a neck finish, a shoulder portion, a sidewall, a base and a web integrally formed with one another, said web located within said container extending between opposing portions of said sidewall, six generally downwardly extending support feet intended to contact a support surface and support said container thereon, said support feet being formed at spaced apart locations circumferentially around said base, two of said support feet having a first height and four of said support feet having a second height, said first and second heights being measured from a common horizontal datum through said container, said first height being less than said second height, wherein said support feet having said first height move, establishing a third height substantially equal to said second height such that all of said support feet contact said support surface when said container is pressurized.

17. The container of claim 16 wherein said support feet having said first height are located generally 90° from a plane defined by said web.

18. The container of claim 16 wherein said support feet having said second height contact said support surface when said container is empty.

19. The container of claim 16 wherein said support feet having said first height are located on said base generally opposite one another and said support feet having said second height are located on said base generally adjacent to said web.

* * * * *